United States Patent [19]

Sprengers

[11] Patent Number: 4,783,612

[45] Date of Patent: Nov. 8, 1988

[54] LOW-PRESSURE SODIUM VAPOR DISCHARGE LAMP WITH PROTECTIVE GLASS LAYER ON ELECTRODE LEAD-THROUGHS

[75] Inventor: Leo M. Sprengers, Eindhoven, Netherlands

[73] Assignee: U.S. Philips Corp., New York, N.Y.

[21] Appl. No.: 617,005

[22] Filed: Jun. 4, 1984

[30] Foreign Application Priority Data

Jun. 15, 1983 [NL] Netherlands ..... 8302128

[51] Int. Cl.[4] ..... H01J 5/50

[52] U.S. Cl. ..... 313/331; 313/636; 313/634; 313/623; 313/332

[58] Field of Search ..... 313/634, 623, 636, 331, 313/332; 174/50.61, 50.58, 152 GM

[56] References Cited

U.S. PATENT DOCUMENTS 3,134,920 1/1961 Van de Weijer et al. ..... 313/636

FOREIGN PATENT DOCUMENTS 580780 8/1959 Canada ..... 313/636
48-10866 4/1973 Japan ..... 313/331
49-33870 9/1974 Japan ..... 313/331

*Primary Examiner*—David K. Moore
*Assistant Examiner*—Michael Razavi
*Attorney, Agent, or Firm*—Emmanuel J. Lobato

[57] ABSTRACT

A low-pressure sodium vapor discharge lamp provided with a discharge tube having an electrical lead-through conductor extending through the wall of the discharge tube to an internal lamp electrode. The lead-through is enveloped by a protective glass layer having a double bead construction. The layer portion facing the electrode is borate glass and is thinner than a second portion within the discharge tube wall which is lime glass. The lead-through construction thus obtained has a high resistance to sodium in the discharge tube and also to mechanical forces.

6 Claims, 1 Drawing Sheet

LOW-PRESSURE SODIUM VAPOR DISCHARGE LAMP WITH PROTECTIVE GLASS LAYER ON ELECTRODE LEAD-THROUGHS

BACKGROUND OF THE INVENTION

The invention relates to a low-pressure sodium vapor discharge lamp provided with a discharge tube which is equipped with at least two internal electrodes, each of the two electrodes being connected to at least one lead-through conductor through the wall of the discharge tube, with the lead-through conductor enveloped both at the area of the wall of the discharge tube and inside the discharge tube by a protective layer consisting of glass.

A known low-pressure sodium vapor discharge lamp of the aforementioned kind is described, for example, in U.S. Pat. No. 3,519,865. In this known lamp, the protective layer has a substantially uniform thickness and an additional auxiliary means, such as, for example, a screening disk, is present between the electrode and the protective layer. The additional auxiliary means serves to prevent the protective layer being reached by a sodium—present in the discharge tube—and attacked by it. The complication of such an additional means in the discharge tube is a disadvantage.

SUMMARY OF THE INVENTION

The invention has for its object to provide a low-pressure sodium vapor discharge lamp of the kind mentioned in the opening paragraph, in which on the one hand no additional auxiliary means for screening the protective layer is required and on the other hand the protective layer nevertheless is substantially not attacked by the sodium in the discharge tube.

A low-pressure sodium vapor discharge lamp according to the invention is provided with a discharge tube equipped with at least two internal electrodes, each of the two electrodes being connected to at least one lead-through conductor which extends through the wall of the discharge tube, while a lead-through conductor is enveloped both at the area of the wall of the discharge tube and inside the discharge tube by a protective layer consisting of glass. The invention is characterized by the protective layer comprising two aligned portions of different composition, a transition from the first layer portion to the second layer portion being within the wall of the discharge tube, while only the first layer portion of the two layer parts extends into the interior of the discharge tube and is resistant to sodium. The layer thickness of the second layer is between between 1.5 and 5 times that of the first layer portion.

An advantage of this lamp is that no additional auxiliary means is required for screening the protective layer from sodium. In fact, the first layer portion of the protective layer extending into the discharge tube is resistant to sodium. The second layer portion is screened by the first layer portion from the sodium in the interior of the discharge tube.

The following explanation is given. The invention is based on the recognition of the fact that in the absence of an additional auxiliary means, as mentioned above, the requirements the protective layer has to satisfy are different for the part of this layer located inside the discharge tube—such as resistance to sodium—from those for the second layer portion within the wall of the discharge tube—such as the ability to absorb forces. The invention is further based on the feature of the protective layer being comprised of aligned parts, which have different glass compositions and also different thicknesses. Thus, the generally contrasting requirements which the protective layer has to satisfy inside the discharge tube and within the wall of the discharge tube can nevertheless be met. The larger thickness of the second layer portion results in the latter being more suitable to absorb forces.

The protective layer composed of two layer portions can be designated as "double bead".

In an advantageous embodiment of the lamp according to the invention, the first layer portion consists of borate glass and the second layer portion consists of lime glass.

An advantage of this embodiment is that it can also be readily manufactured. The forces due to rapid temperature variations which may occur during the manufacture of the discharge tube can then in fact be absorbed in a reliable manner. This embodiment is further capable of withstanding a rapid temperature variation which may occur durinag the operation of the lamp—in the proximity of the lead-through—for example if a comparatively cold drop of sodium which is present in the discharge tube falls onto the first layer portion.

BRIEF DESCRIPTION OF THE DRAWINGS

The invention will be described more fully with reference to a drawing. In the drawing:

FIG. 2 shows on a different scale an electrode of the lamp shown in FIG. 1 and the associated electrical lead-through and a protective layer—constructed as a double bead—enveloping the lead-through;

FIG. 3 shows a combination of FIG. 2 and of a part of the wall of the discharge tube of the lamp of FIG. 1 located near the electrical lead-through.

DETAILED DESCRIPTON OF THE INVENTION

Figure 1:
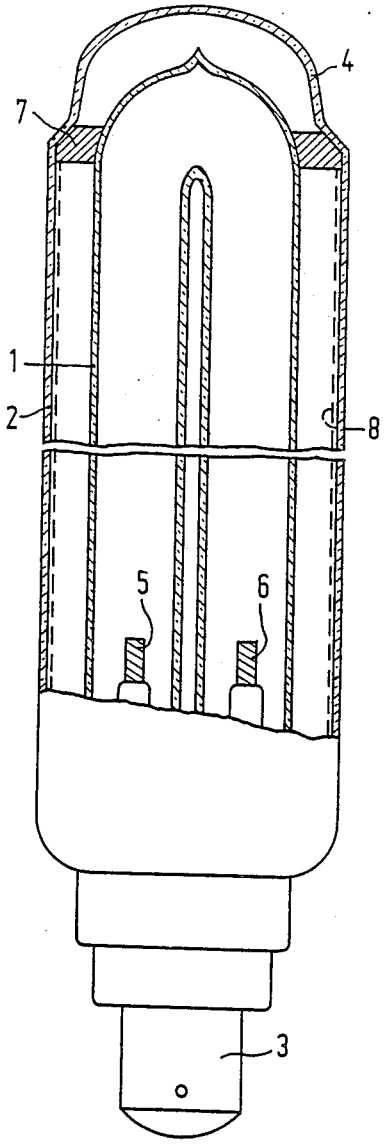
FIG. 1 is a longitudinal sectional view, and partly an elevation, of a low-pressure sodium vapour discharge lamp according to the invention.

In FIG. 1, reference numeral 1 designates a U-shaped discharge tube, which is located in an outer bulb 2 of circular-cylindrical shape. Reference numeral 3 denotes a lamp cap of this sodium lamp. The outer bulb 2 is provided on the side remote from the lamp cap 3 with a semi-spherical seal 4. Reference numerals 5 and 6 designate electrodes which are located in the one and in the other end, respectively, of the discharge tube 1. These electrodes are connected to current-supply members which form part of the lamp cap 3. Reference numeral 7 denotes a metal member which serves to support the curved portion of the U-shaped discharge tube 1 with respect to the outer bulb 2. The inner wall of the outer bulb 2 is provided with an indium oxide layer 8 which transmits the sodium light, but reflects infrared radiation. The layer thickness is approximately 0.3 $\mu$m. The length of the lamp is approximately 20 cm. The diameter of the outer bulb 2 is approximately 5 cm. In the operating condition, this lamp has a power consumption of about 18 W. The luminous flux is then approximately 1900 lumen.

If desired, the discharge tube of the described lamp may further be provided with a few bumps for keeping the sodium uniformly distributed.

Figure 2:
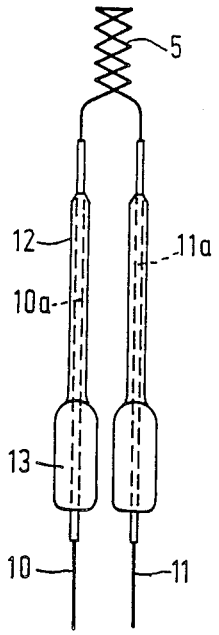

In FIG. 2, the electrode 5 of FIG. 1, with its lead-through, is shown on an enlarged scale. This electrode 5 is connected via two lead-through conductors 10*a* and 11*a* to a current-supply member 10 and a current-supply member 11, respectively. The lead-through conductors are made of iron-nickel-chromium which is resistant to sodium. The current-supply members are made of iron-nickel-cobalt. The lead-through conductor 10*a* is enveloped by a protective layer comprising a first layer portion 12 of borate glass and a second layer portion 13 of lime glass in alignment therewith.

The lead-through conductors 10*a* and 11*a* each have a circular cross-section of approximately 0.6 mm diameter. The layer thickness of the first layer portion 12 is approximately 0.3 mm. The layer thickness of the second layer portion 13 is about 0.7 mm. The layer thickness of the second layer portion 13 is therefore approximately 2.3 times that of the first layer portion 12. This means that the ratio between the layer thickness of the second layer portion and that of the first layer portion lies between 1.5 and 5. The outer diameter of the first layer portion 12 is 1.2 mm. The outer diameter of the second layer portion 13 is 2.0 mm. The length of the first layer portion 12, measured in the longitudinal direction of the lead-through conductor 10*a*, is approximately 21 mm. The corresponding length of the second layer portion 13 is about 10 mm.

The composition in % by weight of the borate glass of the first layer portion 12 and the composition in % by weight of the lime glass of the second layer portion 13 are indicated in the following table.

TABLE

| | Borate glass | Lime glass |
|---|---|---|
| $SiO_2$ | 5.5 | 61.6 |
| $B_2O_3$ | 18.1 | 1.4 |
| $Al_2O_3$ | 8.6 | 4.6 |
| $Na_2O$ | — | 17.9 |
| $K_2O$ | 0.2 | 0.8 |
| MgO | 5.0 | 3.3 |
| CaO | 9.8 | 4.8 |
| BaO | 50.3 | 5.0 |
| SrO | 0.9 | 0.1 |
| $ZrO_2$ | 1.5 | — |
| $SO_3$ | | 0.45 |
| rest | ≦0.1 | ≦0.1 |

The viscosity properties are such that the temperature range within which the lime glass can be deformed in a controllable manner is larger than that of the borate glass.

The protective layer around the lead-through conductor 11*a*, as far as the dimensions and the compositions are concerned, is equal to the protective layer around the lead-through conductor 10*a*.

The electrode 6 (see FIG. 1) is also connected to two lead-through conductors (not shown). Each of these lead-through conductors is also provided with a double bead in such a manner that the lead-throughs thus obtained—as to the construction and the composition—are substantially equal to those of the electrode 5.

Figure 3:
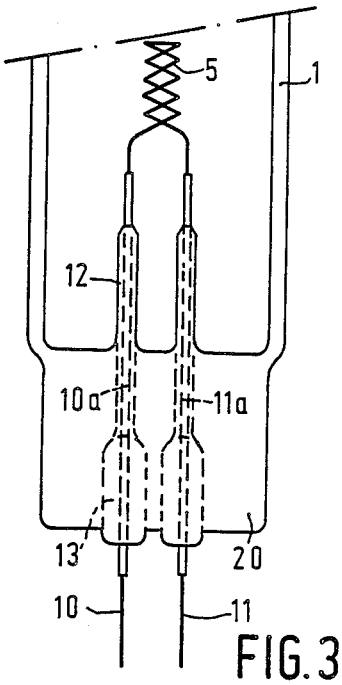

FIG. 3 shows the assembly of FIG. 2, but now at a further stage of manufacture, i.e. after this assembly has been connected—via a glass pinch 20—to the glass of the discharge tube 1. Corresponding reference numerals in the FIGS. 2 and 3 designate the same lamp components.

An electrode (5,6) could alternatively be connected to only one lead-through conductor—provided with a double bead.

The glass of the wall and of the pinch of the discharge tube 1 may alternatively contain a lime glass whose side facing the interior of this tube is coated with a borate glass. The interface between a double bead (12,13) on the one hand and the glass of the discharge tube on the other hand is generally observable at the finished lamp. This is due, for example, to deviations in the composition of the various glass parts.

The described lamp in accordance with the invention has a lead-through construction which is resistant to sodium and which further satisfies the requirements with respect to the absorption of forces—such as those occurring due to rapid temperature variations.

What is claimed is:

1. In a low-pressure sodium vapor discharge lamp of the type having an envelope, a discharge electrode within said envelope, and a conductive lead-through extending through and into said envelope and connected to said discharge electrode for allowing electrical connection to said discharge electrode from outside said envelope, the improvement comprising: a layer of glass covering said lead-through and having a composition and thickness that varies according to the location on said lead-through, said layer of glass comprising a first portion comprised of a glass resistant to sodium and extending over the part of said lead-through within said envelope and a portion of the part of said lead-through embedded within the wall of said envelope, and said layer of glass comprising a second portion extending from said first portion over the remainder of the part of said lead-through embedded within said envelope wall and having a glass composition different from that of said first portion and a thickness greater than that of said first portion.

2. In a low-pressure sodium vapor discharge lamp according to claim 1, wherein the thickness of said second portion is between about 1.5 to about 5 times the thickness of said first portion.

3. In a low-pressure sodium vapor discharge lamp according to claim 2, wherein the first portion is a borate glass and the second portion is a lime glass.

4. In a low-pressure sodium vapor discharge lamp according to claim 1, wherein the first portion is a borate glass and the second portion is a lime glass.

5. In a low-pressure sodium vapor discharge lamp having an envelope with at least one end closed at a pinch seal, a discharge electrode disposed within said envelope proximate said pinch seal, and a conductive lead-through extending through and embedded with said pinch seal and having a part within said envelope and connected to said electrode, another part embedded within said pinch seal and a part outside said envelope, the improvement comprising a glass layer of non-uniform thickness covering a substantial portion of the parts of said lead-through within said envelope and embedded within said pinch seal, said glass layer having a first portion covering a substantial portion of the part of said lead-through within said lamp envelope and a portion of the part of said lead-through embedded within said pinch seal, and said glass layer having a second portion between about 1.5 to about 5 times thicker than said first portion, having a composition different from said first portion and covering substantially the remainder of the part of lead-through embedded within said pinch seal.

6. In a low-pressure sodium vapor discharge lamp according to claim 5, wherein said glass layer first portion is a borate glass and said second portion is a lime glass.

* * * * *